US011925228B1

(12) United States Patent
Polosajian

(10) Patent No.: US 11,925,228 B1
(45) Date of Patent: Mar. 12, 2024

(54) MOTORCYCLE AND MOTORCYCLE HELMET CAMERA SYSTEM

(71) Applicant: Leo Polosajian, Reseda, CA (US)

(72) Inventor: Leo Polosajian, Reseda, CA (US)

( * ) Notice: Subject to any disclaimer, the term of this patent is extended or adjusted under 35 U.S.C. 154(b) by 0 days.

(21) Appl. No.: 18/117,153

(22) Filed: Mar. 3, 2023

(51) Int. Cl.
*A42B 3/04* (2006.01)
*A42B 3/06* (2006.01)
*A42B 3/10* (2006.01)

(52) U.S. Cl.
CPC ..... *A42B 3/0426* (2013.01); *A42B 3/066* (2013.01); *A42B 3/10* (2013.01)

(58) Field of Classification Search
CPC ..... A42B 3/0426; A42B 3/066; A42B 3/10
See application file for complete search history.

(56) References Cited

U.S. PATENT DOCUMENTS 9,060,221 B1 * 6/2015 Kaplan ..... H04R 1/028
9,247,779 B1 * 2/2016 Aloumanis ..... A42B 3/0426
9,389,677 B2 * 7/2016 Hobby ..... G06F 3/005
9,445,639 B1 * 9/2016 Aloumanis ..... G02B 27/017
9,451,802 B2 * 9/2016 Shearman ..... H04N 5/91
10,187,555 B2 * 1/2019 Houba ..... H05K 5/0026
10,257,434 B2 * 4/2019 Arnold ..... A42B 3/042
10,321,102 B2 * 6/2019 Zhang ..... H04N 23/66
10,484,652 B2 * 11/2019 Hobby ..... H04B 1/385
10,491,819 B2 * 11/2019 Corcoran ..... G06F 18/24
10,542,222 B2 * 1/2020 Arnold ..... A42B 3/30
11,533,961 B1 * 12/2022 Dolce ..... G06F 1/163
11,606,999 B2 * 3/2023 Neubauer ..... A42B 3/063
2006/0277666 A1 * 12/2006 Gertsch ..... A42B 3/04 2/424
2013/0311075 A1 * 11/2013 Tran ..... B60W 50/14 701/117
2014/0273863 A1 * 9/2014 Luizzi ..... A42B 3/30 455/66.1
2014/0362244 A1 * 12/2014 Martin ..... H04N 23/65 348/211.2
2017/0331986 A1 * 11/2017 Houba ..... H04N 23/698
2018/0014597 A1 * 1/2018 Cooke ..... A42B 3/042
2018/0188813 A1 * 7/2018 Saez ..... G06F 3/005
2018/0249087 A1 * 8/2018 Arnold ..... H04N 23/698

* cited by examiner

*Primary Examiner* — Khaled Annis
(74) *Attorney, Agent, or Firm* — Lewis Roca Rothgerber Christie LLP

(57) ABSTRACT

A camera system includes a motorcycle helmet having an energy-absorbing inner liner, an outer shell surrounding at least a portion of the energy-absorbing inner liner, and a number of pockets in the motorcycle helmet. Each pocket includes an opening in the outer shell and a recess in the energy-absorbing liner. The camera system also includes a number of cameras in the pockets in the motorcycle helmet, and each camera includes a lens, an image sensor, and a processor. The camera system also includes a number of lens covers covering the cameras, and each lens cover is conformal with a portion of the outer shell proximate to the lens cover such that the cameras and the lens covers do not appreciably increase the aerodynamic drag of the motorcycle helmet.

13 Claims, 3 Drawing Sheets

MOTORCYCLE AND MOTORCYCLE HELMET CAMERA SYSTEM

BACKGROUND

1. Field

The present disclosure relates to motorcycle and motorcycle helmet camera systems.

2. Description of the Related Art

A variety of different vehicle camera systems exist. For instance, automobiles may include integrated cameras as part of the vehicle's automated detection and avoidance system (ADAS system) and/or part of the vehicle's autonomous or semi-autonomous driving system. Additionally, users may mount a dashcam on the dash of the vehicle to monitor traffic in the event of a collision. However, motorcycles have fewer types of camera systems available. For instance, one available motorcycle camera system is stuck on top of the motorcycle helmet, such as with a suction cup. However, such camera systems contribute appreciably to the aerodynamic drag of the helmet, which may adversely affect the rider's comfort and maneuverability. Additionally, such camera systems are conspicuous and therefore they may impair the rider's ability to accurately capture various interactions (e.g., a traffic collision) because the other party will know he/she is being recorded.

The above information disclosed in this Background section is only to enhance understanding of background information pertaining to the present disclosure and may contain information that does not constitute prior art.

SUMMARY

The present disclosure relates to various embodiments of a camera system for a motorcycle and/or a motorcycle helmet. In one embodiment, the camera system includes a motorcycle helmet having an energy-absorbing inner liner, an outer shell surrounding at least a portion of the energy-absorbing inner liner, and a number of pockets in the motorcycle helmet. Each pocket includes an opening in the outer shell and a recess in the energy-absorbing liner. The camera system also includes a number of cameras in the pockets in the motorcycle helmet, and each camera includes a lens, an image sensor, and a processor. The camera system also includes a number of lens covers covering the cameras, and each lens cover is conformal with a portion of the outer shell proximate to the lens cover such that the cameras and the lens covers do not appreciably increase the aerodynamic drag of the motorcycle helmet.

This summary is provided to introduce a selection of features and concepts of embodiments of the present disclosure that are further described below in the detailed description. This summary is not intended to identify key or essential features of the claimed subject matter, nor is it intended to be used in limiting the scope of the claimed subject matter. One or more of the described features may be combined with one or more other described features to provide a workable motorcycle or motorcycle helmet camera system.

BRIEF DESCRIPTION OF THE DRAWINGS

The features and advantages of embodiments of the present disclosure will be better understood by reference to the following detailed description when considered in conjunction with the drawings. The drawings are not necessarily drawn to scale.

DETAILED DESCRIPTION

The present disclosure relates to various embodiments of a camera system for a motorcycle helmet and/or a motorcycle. In one or more embodiments, the camera system for the motorcycle helmet includes two or more cameras that are flush (or substantially flush) with an exterior surface of the motorcycle helmet. In this manner, the cameras do not increase (or at least do not appreciably increase) the aerodynamic drag of the motorcycle helmet. Additionally, in one or more embodiments, the cameras may not be conspicuous (e.g., the cameras may be concealed) such that individuals are unaware they are being filmed. Furthermore, in one or more embodiments, the camera system may include one or more features to prevent the camera from compromising the integrity (e.g., the crash rating) of the motorcycle helmet.

Figure 1:
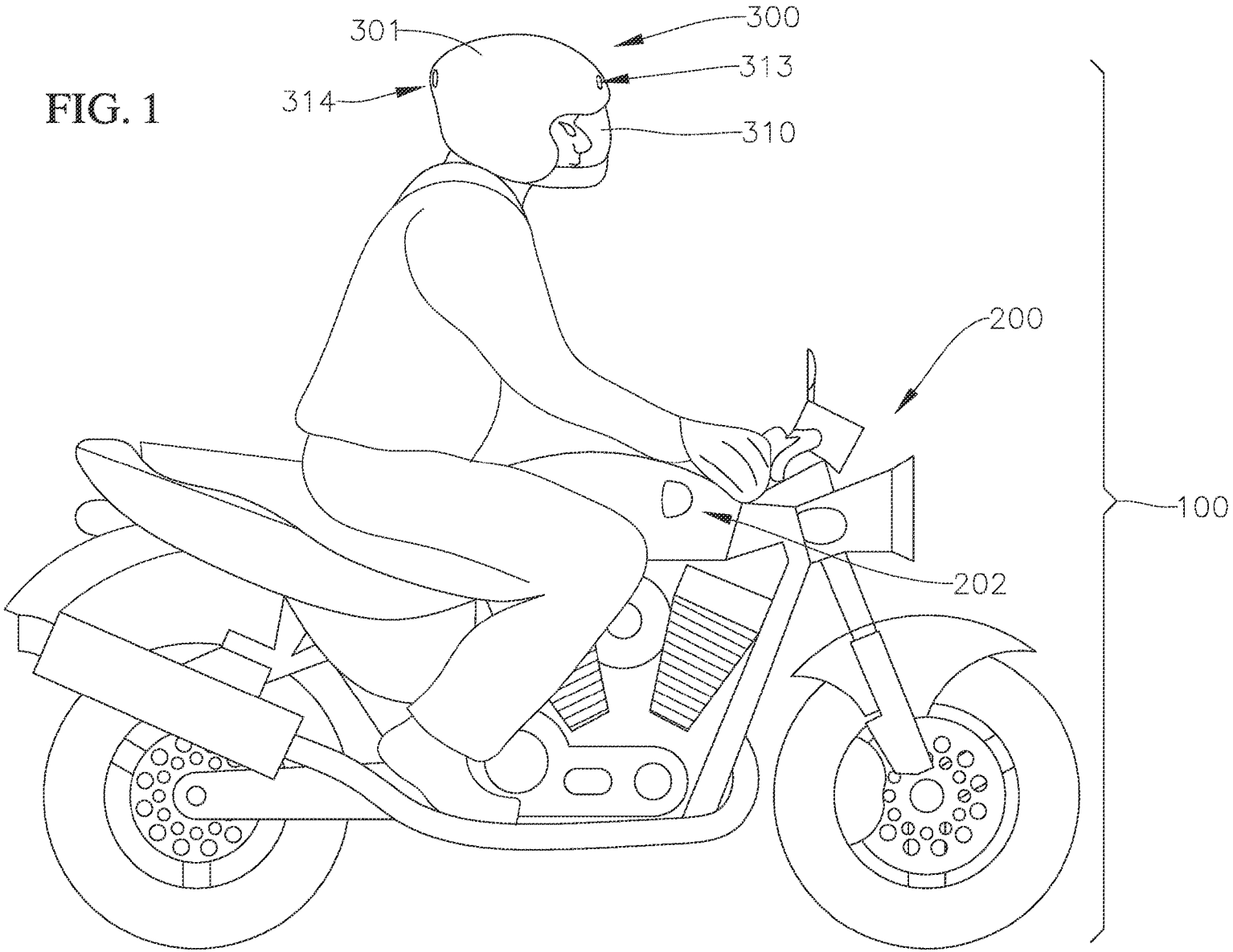
FIG. 1 is a perspective view a camera system including a motorcycle camera system and a motorcycle helmet camera system according to one embodiment of the present disclosure.
Figure 2A:
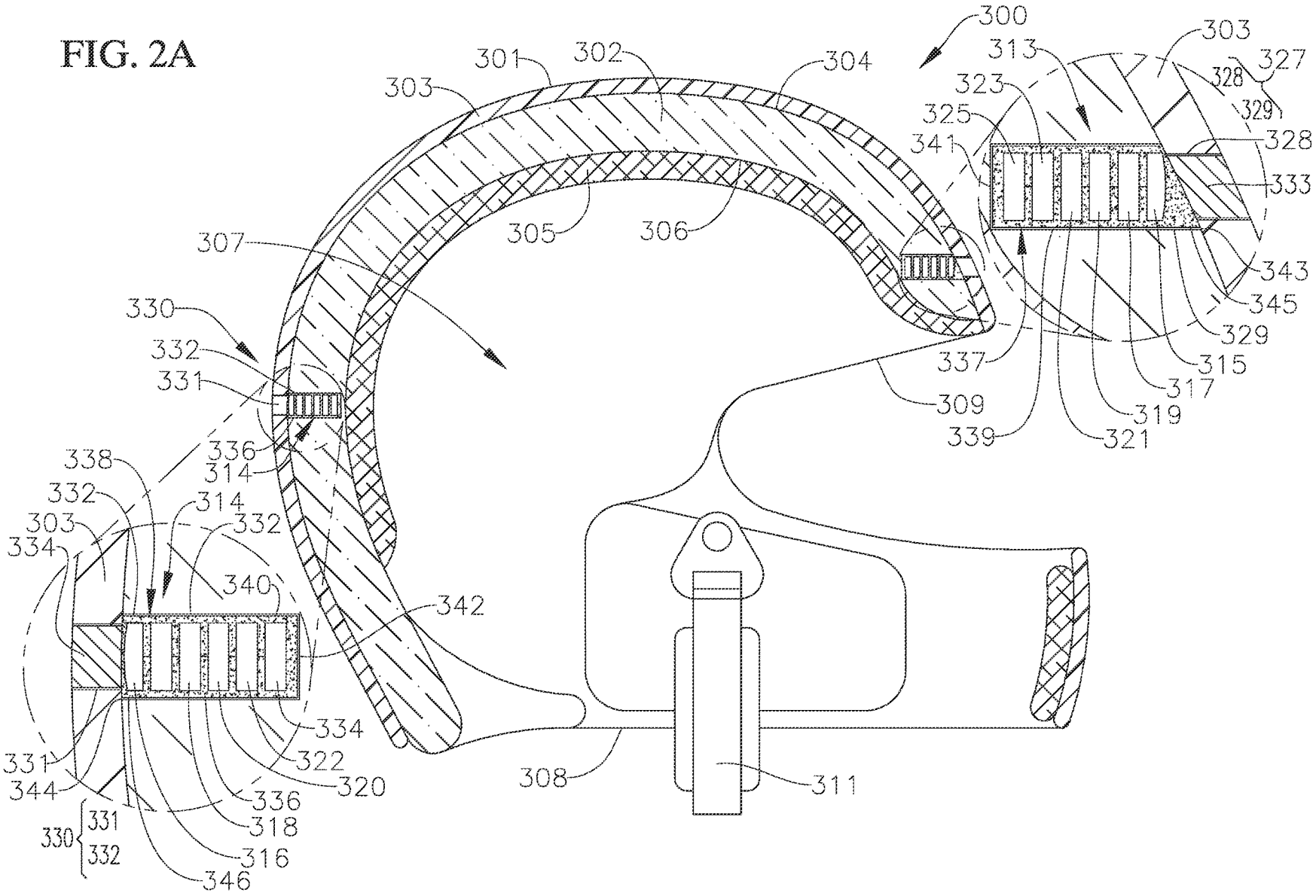
FIGS. 2A-2B are cross-sectional views of the motorcycle helmet camera system and the motorcycle camera system, respectively, according to the embodiment illustrated in FIG. 1.
Figure 2B:
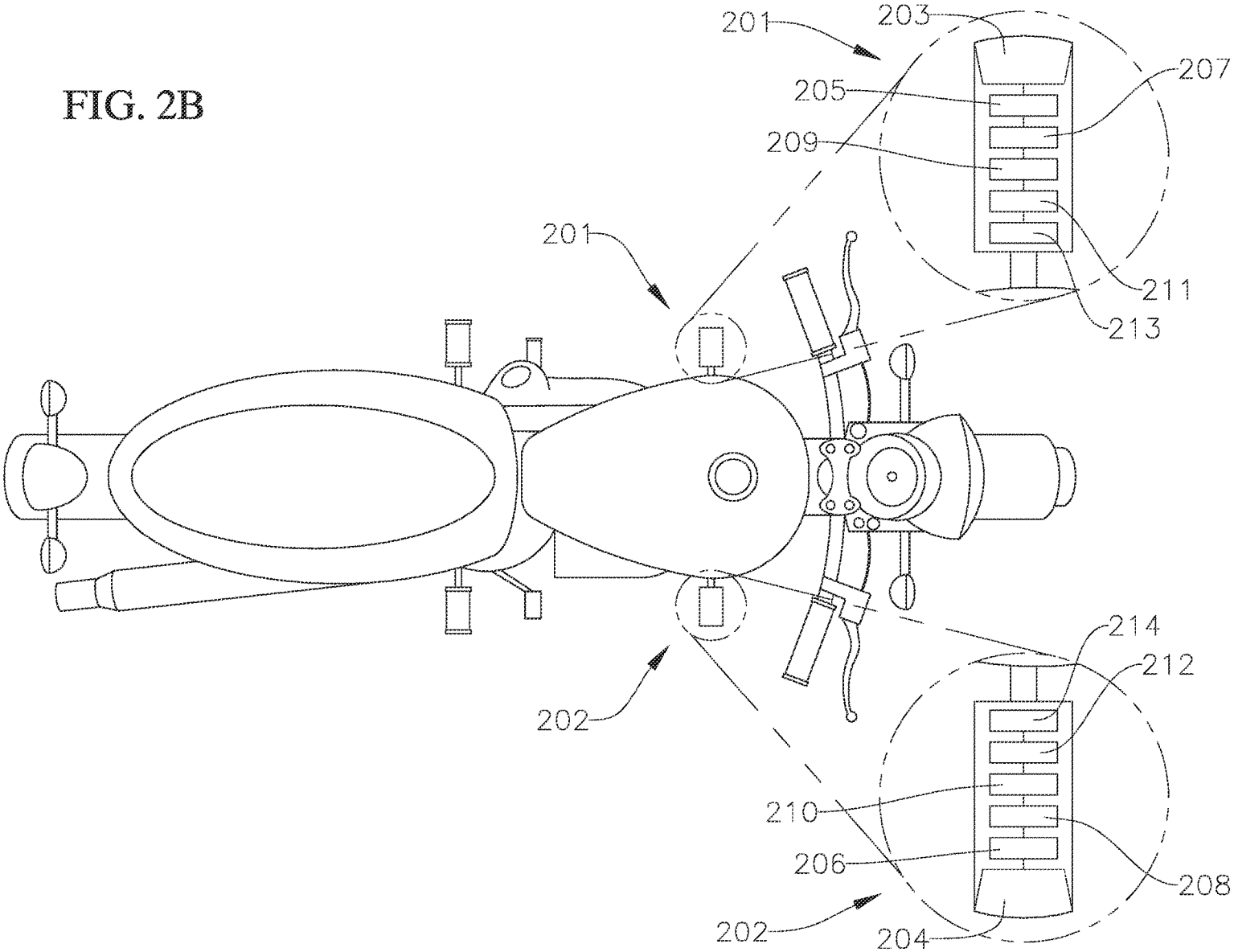

With reference now to FIGS. 1-2B, a camera system 100 according to one embodiment of the present disclosure includes a motorcycle camera system 200 and a motorcycle helmet camera system 300. As described in more detail below, the motorcycle camera system 200 and the motorcycle helmet camera system 300 may function in conjunction to capture a 360-degree (or substantially a 360-degree) view around the motorcycle rider. In this manner, the camera system 100 is configured to record traffic accidents or other incidents.

In the illustrated embodiment, the motorcycle helmet camera system 300 includes a motorcycle helmet 301 having an energy-absorbing liner 302, an outer shell 303 surrounding the energy-absorbing liner 302 (i.e., an outer shell 303 on an outer surface 304 of the energy-absorbing liner 302), and an inner comfort liner or comfort padding 305 on an inner surface 306 of the energy-absorbing liner 302. Together, the energy-absorbing liner 302, the outer shell 303, and the inner comfort liner 305 form an inner cavity 307 configured to accommodate a rider's head, a lower opening 308 in communication with the inner cavity 307 to enable the rider to wear the motorcycle helmet 301 and to remove the motorcycle helmet 301, and a front opening 309. The motorcycle helmet 301 also includes a face shield 310 (e.g., a visor) hingedly coupled to the outer shell 303 that is configured to move between closed position in which the front opening 309 is covered by the face shield 310 and an open position in which at least a portion of the front opening 309 is uncovered by the face shield 310. In the illustrated embodiment, the motorcycle helmet 301 also includes a retention system 311 (e.g., a chin strap) coupled to the outer shell 303 and configured to secure the motorcycle helmet 301 to the rider's head.

The motorcycle helmet camera system 300 also includes a camera system 312 coupled to the motorcycle helmet 301. In one or more embodiments, the camera system 312 includes at least two cameras. In the illustrated embodiment, the camera system 312 includes a front camera 313 and a rear camera 314. In one or more embodiments, the camera system 312 may include a pair of lateral cameras (i.e., a left lateral camera and a right lateral camera), or both a pair of front and rear cameras and a pair of lateral cameras. Each camera 313, 314 includes a lens 315, 316 (e.g., a wide-angle lens), respectively, a camera sensor 317, 318, respectively, behind the lens 315, 316, respectively, and an image signal processor (ISP) 319, 320, respectively, coupled to the camera sensor 317, 318, respectively. The ISP 319, 320 of each camera 313, 314 stores computer-executable (i.e., computer-readable instructions) which, when executed by the ISP 319, 320, cause the ISP 319, 320 to generate an image based on the electrical signal output by the camera sensor 317, 318, respectively. The front and rear cameras 313, 314 are configured to capture videos longitudinally (i.e., to the front and to the rear of the motorcycle and the rider). In one or more embodiments, each of the front and rear cameras 313, 314 includes a power source 321, 322 (e.g., a rechargeable battery) coupled to the ISP 319, 320, respectively. Additionally, in one or more embodiments, each of the front and rear cameras 313, 314 may include a network adapter 323, 324, respectively, (e.g., a WiFi chip or a Bluetooth™ chip) coupled to the ISP 319, 320. In the illustrated embodiment, each of the front and rear cameras 313, 314 also includes a memory device 325, 326, respectively. The memory device 325, 326 may be utilized to locally store the videos captured by the front and rear cameras 313, 314. The network adapter 323, 324 is configured to transmit the videos captured by the front and rear cameras 313, 314 to one or more remote electronic devices.

In one or more embodiments, the ISP 319, 320 includes executable instructions which, when executed by the ISP 319, 320, cause the ISP 319, 320 to send a signal causing the image sensor 317, 318 to capture video from the light entering the lens 315, 316, respectively. In one or more embodiments, the executable instructions, when executed by the ISP 319, 320, cause the memory device 325, 326 to record the video captured by the lens 315, 316 and the image sensor 317, 318, respectively. In one or more embodiments, the executable instructions, when executed by the ISP 319, 320, cause the network adapter 323, 324 to transmit (e.g., wirelessly transmit) the video captured by the lens 315, 316 and the image sensor 317, 318 to a remote electronic device (e.g., a server (i.e., the "cloud"), a desktop computer, or a mobile electronic device, such as a laptop computer, a tablet computer, a smartphone, or a wearable electronic device, such as a smart watch), where the video may be recorded or otherwise stored for later replay.

The term "processor" is used herein to include any combination of hardware, firmware, and software, employed to process data or digital signals. The hardware of a processor may include, for example, application specific integrated circuits (ASICs), general purpose or special purpose central processors (CPUs), digital signal processors (DSPs), graphics processors (GPUs), and programmable logic devices such as field programmable gate arrays (FPGAs). In a processor, as used herein, each function is performed either by hardware configured, i.e., hard-wired, to perform that function, or by more general purpose hardware, such as a CPU, configured to execute instructions stored in a non-transitory storage medium. A processor may be fabricated on a single printed wiring board (PWB) or distributed over several interconnected PWBs. A processor may contain other processors; for example, a processor may include two processors, an FPGA and a CPU, interconnected on a PWB.

In the illustrated embodiment, the motorcycle helmet 301 also includes a front pocket 327 (defined by a front opening 328 in the outer shell 303 and a corresponding front recess 329 in the energy-absorbing liner 302) that accommodates the front camera 313, and a rear pocket 330 (defined by a rear opening 331 in the outer shell 303 and a corresponding rear recess 332 in the energy-absorbing liner 302) that accommodates the rear camera 314. Furthermore, in the illustrated embodiment, the motorcycle helmet 301 includes a front window 333 (i.e., a front lens cover) covering the front pocket 327 (i.e., covering the front opening 328 in the outer shell 303 and the front recess 329 in the energy-absorbing liner 302), and a rear window 334 (i.e., a rear lens cover) covering the rear pocket 330 (i.e., covering the rear opening 331 in the outer shell 303 and the rear recess 332 in the energy-absorbing liner 302). The front and rear windows 333, 334 are transparent or translucent such that light can pass through the front and rear windows 333, 334 and be captured by the front and rear cameras 313, 314. Additionally, in one or more embodiments, the front and rear windows 333, 334 may be integral with the outer shell 303 or may be formed separately from the outer shell 303 and coupled to the outer shell 303 in any suitable manner, such as with adhesive and/or by thermoplastic welding. The front and rear windows 333, 334 may be made of the same material(s) as the outer shell 303, or the front and rear windows 333, 334 may be made of one or more different materials than the outer shell 303. In the illustrated embodiment, the front and rear windows 333, 334 are flush (or substantially flush) with portions of the outer shell 303 immediately surrounding the front and rear windows 333, 334 (i.e., the front and rear windows 333, 334 conform or substantially conform to the portions of the outer shell 303 proximate to the front and rear windows 333, 334). In this manner, the front and rear cameras 333, 334 are configured not to increase the aerodynamic drag of the motorcycle helmet 301, which could otherwise adversely affect the rider's comfort and maneuverability of the motorcycle.

In one or more embodiments, the motorcycle helmet camera system 300 may include one or more features to prevent the front and rear cameras 313, 314 from compromising the integrity (e.g., the crash rating) of the motorcycle helmet 301. In one or more embodiments, the front and rear pockets 327, 330 of the motorcycle helmet 301 may be filled with a safety foam 335, 336 (e.g., a closed-cell foam, such as ethylene-vinyl acetate (EVA), poly (ethylene-vinyl acetate) (PEVA), polyethylene, polystyrene, rubber, or polypropylene closed-cell foam) around the front and rear cameras 313, 314. In one or more embodiments, the motorcycle helmet camera system 300 includes a front casing 337 in the front pocket 327 and a rear casing 338 in the rear pocket 330 of the motorcycle helmet 301. The front and rear casings 337, 338 each include at least one sidewall 339, 340 surrounding the respective front or rear camera 313, 314, respectively, an inner end wall 341, 342 (e.g., a cap or a base plate) at the end of the respective front or rear camera 313, 314, and an open outer end 343, 344 coupled to the outer shell 303 of the motorcycle helmet 301. The front and rear casings may be cylindrical or prismatic. In one or more embodiments, the front and rear casings 337, 338 may be formed of the same material(s) as the outer shell 303 of the motorcycle helmet 301. Additionally, in one or more embodiments, the front and rear casings 337, 338 may be angled away from the inner cavity 307 of the helmet 301 (e.g., the front and rear casings 337, 338 may not be orthogonal to the outer shell 303 of the motorcycle helmet 301). In one or more embodiments, the front and rear casings 337, 338 may be filled with safety foam 335, 336 around the front and rear cameras 313, 314.

Furthermore, in one or more embodiments, the front and rear casings 337, 338 may include one or more breakaway points 345, 346 (e.g., lower portions of the front and rear casings 337, 338 may be coupled to the outer shell 303 with thinner material than other portions of the front and rear casings 337, 338 and/or the lower portions of the front and rear casings 337, 338 may include one or more weakening features, such as score(s), hole(s), and/or groove(s)) that are configured to break during a traffic accident. Positioning the breakaway points 345, 346 along the lower portions of the front and rear casings 337, 338, and the front and rear cameras 313, 314 contained therein, to deflect upward away from the inner cavity 307 of the motorcycle helmet 301 during a traffic accident (e.g., during a traffic accident or other collision, the breakaway points 345, 346 are configured to cause the lower portions of the front and rear casings 337, 338 to detach or decouple from the outer shell 303 such that the front and rear casings 337, 338 hingedly rotate upward about the upper portions of the front and rear casings 337, 338 that remain coupled to the outer shell 303 of the motorcycle helmet 301). Accordingly, in a collision, the front and rear casings 337, 338 surrounding the front and rear cameras 313, 314 are configured to deflect away from the inner cavity 307 of the motorcycle helmet 301 rather than into the inner cavity 307 of the motorcycle helmet 301, which could injure the rider.

In the illustrated embodiment, the motorcycle camera system 200 includes a first lateral camera 201 (e.g., a left-facing camera) and a second lateral camera 202 (e.g., a right-facing camera) coupled (or configured to be coupled) to a motorcycle 400. The first and second lateral cameras 201, 202 may be coupled to the motorcycle 400 in any suitable manner, such as with fasteners (e.g., screws and/or rivets), adhesive, suction cups, hook-and-loop type fasteners, and/or magnets. In one or more embodiments, the first and second lateral cameras 201, 202 may be integrated into (i.e., integral with) the motorcycle 400. The first and second lateral cameras 201, 202 may be located at any suitable location on the motorcycle 400, such as the gas tank, the rear fender, or the front faring. Each lateral camera 201, 202 includes a lens 203, 204 (e.g., a wide-angle lens), a camera sensor 205, 206 behind the lens 203, 204, and an image signal processor (ISP) 207, 208 coupled to the camera sensor 205, 206. The ISP 207, 208 stores computer-executable (i.e., computer-readable instructions) which, when executed by the ISP 207, 208, cause the ISP 207, 208 to generate an image based on the electrical signal output by the camera sensor 205, 206. The first and second lateral cameras 201, 202 are configured to capture videos laterally (i.e., to the left and to the right of the motorcycle 400 and the rider). In one or more embodiments, each of the first and second lateral cameras 201, 202 includes a power source 209, 210 (e.g., a rechargeable battery) coupled to the ISP 207, 208. Additionally, in one or more embodiments, each of the first and second lateral cameras 201, 202 may include a network adapter 211, 212 (e.g., a WiFi chip or a Bluetooth™ chip) coupled to the ISP 207, 208. In the illustrated embodiment, each of the first and second lateral cameras 201, 202 also includes a memory device 213, 214. The memory device 213, 214 may be utilized to locally store the videos captured by the first and second lateral cameras 201, 202. The network adapter 211, 212 is configured to transmit the videos captured by the first and second lateral cameras 201, 202 to a remote electronic device.

In one or more embodiments, the ISP 207, 208 includes executable instructions which, when executed by the ISP 106, cause the ISP 106 to send a signal causing the image sensor 205, 206 to capture video from the lens 203, 204. In one or more embodiments, the executable instructions, when executed by the ISP 207, 208, cause the memory device 213, 214 to record the video captured by the lens 203, 204 and the image sensor 205, 206. In one or more embodiments, the executable instructions, when executed by the ISP 207, 208, cause the network adapter 211, 212 to transmit (e.g., wirelessly transmit) the video captured by the lens 203, 204 and the image sensor 205, 206 to a remote electronic device (e.g., a server (i.e., the "cloud"), a desktop computer, or a mobile electronic device, such as a laptop computer, a tablet computer, a smartphone, or a wearable electronic device, such as a smart watch), where the video may be recorded or otherwise stored for later replay.

In the illustrated embodiment, the lateral videos captured by the lateral cameras 201, 202 on the motorcycle 400 may compliment the front and rear videos captured by the front and rear cameras 313, 314 in the motorcycle helmet 301 such that together the front camera 313, the rear camera 314, the first lateral camera 201, and the second lateral camera 202 capture a 360-degree video (or substantially a 360-degree video) around the motorcycle 400 and the rider. In one or more embodiments, the memory device 213, 214 of one of the lateral cameras 201, 202 may include instructions which, when executed by the ISP 207, 208, cause the ISP 207, 208 to "stitch" the videos together to form a 360-degree video (or substantially a 360-degree video). In one or more embodiments, the remote electronic device (e.g., a server (i.e., the "cloud"), a desktop computer, or a mobile electronic device, such as a laptop computer, a tablet computer, a smartphone, or a wearable electronic device, such as a smart watch), may include computer-readable instructions which, when executed by a processor of the remote electronic device, cause the remote electronic device to "stitch" the videos together to form a 360-degree video (or substantially a 360-degree video). In this manner, the camera system 100 is configured to capture and record video(s) around the motorcycle 400 and the rider, which may be utilized to document or prove the individual responsible for a traffic collision or other accident.

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, and equivalents thereof.

What is claimed is:

1. A camera system comprising:

a motorcycle helmet comprising:

an energy-absorbing inner liner;

an outer shell surrounding at least a portion of the energy-absorbing inner liner;

a plurality of pockets in the motorcycle helmet, each pocket of the plurality of pockets comprising an opening in the outer shell and a recess in the energy-absorbing liner;

a plurality of cameras in the plurality of pockets in the motorcycle helmet, each camera of the plurality of cameras comprising:

a lens;

an image sensor; and a processor; and a plurality of lens covers covering the plurality of cameras, wherein an outer surface of each lens cover of the plurality of lens covers is conformal with an outer surface of a portion of the outer shell proximate to the each lens cover.

2. The camera system of claim 1, wherein the plurality of cameras comprises a front camera and a rear camera.

3. The camera system of claim 1, wherein the plurality of cameras comprises:

a front wide-angle camera; and a rear wide-angle camera.

4. The camera system of claim 1, wherein the plurality of cameras comprises:

a front camera;

a rear camera;

a left camera; and a right camera.

5. The camera system of claim 1, wherein the plurality of lens covers are clear.

6. The camera system of claim 1, wherein the plurality of lens covers are tinted.

7. The camera system of claim 1, wherein the plurality of lens covers and the outer shell are a same material.

8. The camera system of claim 1, wherein the plurality of lens covers and the outer shell are different materials.

9. The camera system of claim 1, further comprising a plurality of casings, each casing of the plurality of casings surrounding one camera of the plurality of cameras.

10. The camera system of claim 1, further comprising safety foam surrounding each camera of the plurality of cameras.

11. The camera system of claim 1, further comprising a plurality of cameras coupled to a motorcycle.

12. The camera system of claim 11, wherein the plurality of cameras comprises a first lateral camera and a second lateral camera.

13. A camera system comprising:

a motorcycle helmet comprising:

an energy-absorbing inner liner;

an outer shell surrounding at least a portion of the energy-absorbing inner liner;

a plurality of pockets in the motorcycle helmet, each pocket of the plurality of pockets comprising an opening in the outer shell and a recess in the energy-absorbing liner;

a plurality of cameras in the plurality of pockets in the motorcycle helmet, each camera of the plurality of cameras comprising:

a lens;

an image sensor; and a processor; and a plurality of lens covers covering the plurality of cameras, wherein each lens cover of the plurality of lens covers is conformal with a portion of the outer shell proximate to the each lens cover;

a plurality of casings, each casing of the plurality of casings surrounding one camera of the plurality of cameras at least one breakaway at a lower end of at least one casing of the plurality of casings.

* * * * *